US009683327B2

(12) United States Patent
Ma et al.

(10) Patent No.: US 9,683,327 B2
(45) Date of Patent: Jun. 20, 2017

(54) CUTTING AND DOUBLE-FACE LEATHER INTEGRATED DYEING PROCESS FOR TAN SHEEP SKIN

(71) Applicant: Ningxia Wuzhong Jingyi Fur-products Co., LTD., Wuzhong (CN)

(72) Inventors: Weining Ma, Wuzhong (CN); Shaohu Ma, Wuzhong (CN); Guowu Ding, Wuzhong (CN); Litao Ma, Wuzhong (CN); Weirong Ma, Wuzhong (CN); Xi Ding, Wuzhong (CN)

(73) Assignee: Ningxia Wuzhong Jingyi Fur-Products Co., LTD., Wuzhong (CN)

( * ) Notice: Subject to any disclaimer, the term of this patent is extended or adjusted under 35 U.S.C. 154(b) by 0 days.

(21) Appl. No.: 15/023,907

(22) PCT Filed: Nov. 7, 2014

(86) PCT No.: PCT/CN2014/090600

§ 371 (c)(1),
(2) Date: Mar. 22, 2016

(87) PCT Pub. No.: WO2015/096557

PCT Pub. Date: Jul. 2, 2015

(65) Prior Publication Data

US 2016/0251802 A1 Sep. 1, 2016

(30) Foreign Application Priority Data

Dec. 25, 2013 (CN) ..... 2013 1 0725261

(51) Int. Cl.

| | |
|---|---|
| ***C14B 1/58*** | (2006.01) |
| ***C14B 5/00*** | (2006.01) |
| ***C14C 1/00*** | (2006.01) |
| ***C14C 3/06*** | (2006.01) |
| ***C14C 3/04*** | (2006.01) |
| ***C14C 5/00*** | (2006.01) |
| ***C14C 9/02*** | (2006.01) |
| ***D06P 5/02*** | (2006.01) |
| ***D06P 5/04*** | (2006.01) |
| ***D06P 1/39*** | (2006.01) |
| ***D06P 1/44*** | (2006.01) |
| ***D06P 1/673*** | (2006.01) |
| ***D06P 3/30*** | (2006.01) |
| ***D06P 3/32*** | (2006.01) |

(52) U.S. Cl.

CPC ..... *D06P 3/3206* (2013.01); *C14B 5/00* (2013.01); *C14C 3/06* (2013.01); *C14C 9/02* (2013.01); *D06P 1/39* (2013.01); *D06P 3/30* (2013.01); *D06P 3/3008* (2013.01); *D06P 5/04* (2013.01); *C14B 1/58* (2013.01); *C14C 1/00* (2013.01); *C14C 3/04* (2013.01); *C14C 5/00* (2013.01); *D06P 1/44* (2013.01); *D06P 1/673* (2013.01); *D06P 5/02* (2013.01)

(58) Field of Classification Search

CPC .... C14B 1/58; C14B 5/00; C14C 1/00; C14C 3/06; C14C 3/04; C14C 5/00; C14C 5/02; C14C 9/02; D06P 1/39; D06P 1/44; D06P 1/673; D06P 3/3206; D06P 3/30; D06P 3/3008; D06P 5/04; D06P 5/02

See application file for complete search history.

(56) References Cited

FOREIGN PATENT DOCUMENTS

| | | | |
|---|---|---|---|
| CN | 1136905 | | 12/1996 |
| CN | 1326004 | | 12/2001 |
| CN | 101871171 | | 10/2010 |
| CN | 102493230 | | 6/2012 |
| CN | 102517928 | | 6/2012 |
| CN | 102586505 | | 7/2012 |
| CN | 102912659 | | 2/2013 |
| CN | 103243186 | | 8/2013 |
| CN | 103243586 | * | 8/2013 |
| CN | 103243587 | | 8/2013 |
| CN | 103726361 | | 4/2014 |
| GB | 152448 | | 9/1978 |

OTHER PUBLICATIONS

Translation CN 103243586. Aug. 2013.*

MSDS appendix provided by applicant for tradnnames in claims, Jan. 26, 2017.*

Internet communication authorization sheet provided by applicant Jan. 26, 2017.*

English translationof MSDS Jan. 26, 2017.*

Cheng, Fengxia, "Dyeing technology of wool shearing fur and doubleface from sheep skin", China Leather, Sep. 2004, vol. 33, No. 17, pp. 52-53.

(Continued)

*Primary Examiner* — Amina Khan

(74) *Attorney, Agent, or Firm* — Dinsmore & Shohl LLP

(57) ABSTRACT

A cutting and double-face leather integrated dyeing process for Tan sheep skin, which comprises the following steps: cutting→washing with water→retanning→primary dyeing→primary color fixing→secondary dyeing→fatliquoring→secondary color fixing→bleaching→drying→a finished product. Tan sheep skin leather boards and fleeces dyed by the process of the invention have no cross color and color fading with each other, a high color fastness, and uniform dyeing; the prepared Tan sheep skin products such as clothing, etc., not only have the characteristics of a high added value and good practicability, but also can more largely increase product benefits and lower the production cost.

4 Claims, 1 Drawing Sheet

(56) References Cited

OTHER PUBLICATIONS

Cheng, Fengxia et al., "Technology of tanning and dyeing for beaver rabbit suede double face with vein marks," China Leather, Dec. 2003, vol. 32, No. 23, p. 18-20 and 23-25.
Written Opinion of the International Searching Authority issued in co-pending international patent application No. CN 201310725261.5, dated Feb. 6, 2015.

* cited by examiner

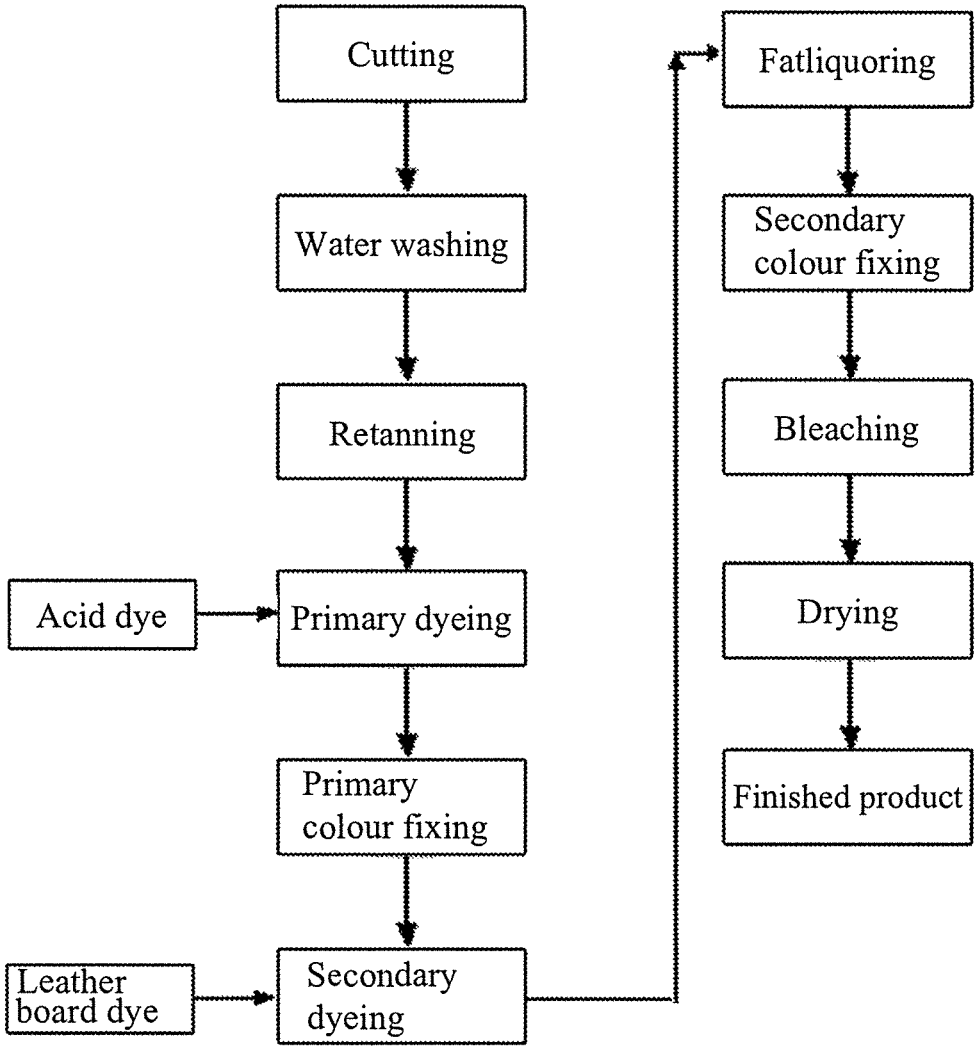
Cutting
Water washing
Retanning
Acid dye
Primary dyeing
Primary colour fixing
Leather board dye
Secondary dyeing
Fatliquoring
Secondary colour fixing
Bleaching
Drying
Finished product

CUTTING AND DOUBLE-FACE LEATHER INTEGRATED DYEING PROCESS FOR TAN SHEEP SKIN

CROSS-REFERENCE TO RELATED APPLICATIONS

This application is the U.S. national phase application of international application Serial No. PCT/CN2014/090600, filed Nov. 7, 2014, which claims priority from international application Serial No. CN 201310725261.5, filed Dec. 25, 2013, the contents of each of which are incorporated herein in their entirety.

FIELD OF THE INVENTION

The invention relates to the technical field of animal fur processing, and particularly relates to a cutting and double-face leather integrated dyeing process for Tan sheep skin.

DESCRIPTION OF THE PRIOR ART

Tan sheep is a rare and exclusive fur sheep species in Ningxia, whose second fur is famous for lightness, thinness, softness, warmth and "nine crimps" containing as many as nine crimps and plump leather board with wool spikes natural to tuft, and is one of the five treasures in Ningxia called "white treasure", and also, is the advantageous pasturage resource in the district of Ningxia, thus, has won high reputation home and abroad. In existing technology, typically, the excellent part, i.e. nine crimps of Tan sheep fur may be processed and manufactured, and the dyeing process includes bath dyeing, brush dyeing, spray dyeing, print dyeing, discharge, steaming dyeing, tie dyeing, coating and so on, yet the particularity of the organization structure and the fur of the Tan sheep would cause dyeing fleeces easy to pollute leather board, dyeing leather board easy to pollute fleeces, migration dyeing of fleeces, leather boards and fleeces having cross colour with each other, colour fading, low colour fastness, ununiform dyeing and so on. Thus, to enhance the added value of Tan sheep fur, it is necessary to provide a process used to manufacture the Tan sheep fur which does not reach a superior quality (third grade) with uniform dyeing and used for double-face leather integrated dyeing.

SUMMARY OF THE INVENTION

The object of this invention is to provide a cutting and double-face leather integrated dyeing process for Tan sheep skin, which may cut the Tan sheep skin which does not reach a superior quality (third grade), and do double-face leather integrated dyeing, while may keep the leather boards soft, the colour fastness of fur high, no dyeing defect, and no colour difference.

To achieve the above objective, the invention adopts technical schemes as follows: a cutting and double-face leather integrated dyeing process for Tan sheep skin, comprising the following steps:

S1: Cutting: Selecting the third-grade Tan sheep skin to do the cutting treatment, the cutting length is about 2-3 cm;

S2: Washing with water: Washing the cut Tan sheep skin with water;

S3: Retanning: Retanning the Tan sheep skin washed with water;

S4: Primary dyeing: Putting the retanned Tan sheep skin into a paddle to do the primary dyeing treatment, and a temperature for the primary dyeing treatment being 60-70° C., lasting for 2-3 hours, a PH value of the primary dye liquor being 2.5-3.5, a liquid ratio being 1:20; said primary dye liquor including 0.5 ml/L of fur colour leveling agent FM, 5 g/L of anhydrous sodium sulfate, 0.5 ml/L of brightening agent HO and 1.5-5 g/L of acid dye;

S5: Primary colour fixing: After the primary dyeing treatment, the primary colour fixing treatment is done by putting 0.5-1.0 ml/L of formic acid into the paddle every 30 minutes for two to three times, and after the primary colour fixing, taking the skin out and changing the water;

S6: Secondary dyeing: After the primary colour fixing, putting the Tan sheep skin into the paddle to do the secondary dyeing treatment, and a temperature for the secondary dyeing treatment being 25-30° C., lasting for 60-70 minutes, a PH value of the secondary dye liquor being 2.0-3.0, a liquid ratio being 1:20; said secondary dye liquor including 0.5 g/L of leather board leveling agent, 0.5 ml/L of ammonia water and 2-4 g/L of leather board dye;

S7: Fatliquoring: After the secondary dyeing treatment, the fatliquoring treatment is done by putting a fatliquoring agent into the paddle and rotating it for 90-95 minutes, said fatliquoring agent including 3 ml/L of fatliquoring agent GH and 4 ml/L of fatliquoring agent FLP;

S8: Secondary colour fixing: After the fatliquoring, the secondary colour fixing treatment is done by putting 1.5-2.0 ml/L of formic acid into the paddle, and rotating it for 1 hour, then putting 1.5-2.0 ml/L of formic acid every 30 minutes for three to four times, and after the secondary colour fixing, taking the skin out;

S9: Bleaching: After the secondary colour fixing treatment, the bleaching treatment is done by putting 0.5-1.5 ml/L of fur degreasing agent FD-59 into the paddle and bleaching for 15-20 minutes;

S10: Drying: Shaking the bleached Tan sheep skin dry, nailing the skin on a plate, air drying naturally and getting a finished product.

The temperature for the retanning treatment in S3 is 35-40° C., lasting for 24 hours, and a retanning agent used in the retanning treatment includes 6-10 g/L of chromium powder, 20-30 g/L of salt and 0.5-1.5 ml/L of sulfuric acid.

The total quantity of formic acid added during the primary colour fixing in S5 is 2000-3000 ml.

The total quantity of formic acid added during the secondary colour fixing in S8 is 3000-4000 ml.

In the invention, the third-grade Tan sheep skin which does not reach a superior quality is selected and subjected to cutting treatment, and during the process of double-face leather integrated dyeing, the dyeing and colour fixing treatment of fleece and leather board are carried out sectionally, and the dyeing temperature, the dyeing time, the PH value and the added auxiliaries are all controlled within an optimal range, so that the fur is prevented from excessive colouring to avoid the phenomena such as dyeing defect and colour difference, and after the dyeing has been completed, the leather board has softness, good fullness and elongation, substantially uniform thickness, and no phenomena such as stiff board and swelling board occur; the fleece is smooth, flexible and loose and clean with complete needle velvet, and no phenomena such as serious fur shedding, oily fur and fur twisting occur. Therefore, Tan sheep skin leather board and fleeces dyed by the above technical scheme have no cross colour and colour fading with each other, high colour fastness, and uniform dyeing; the manufactured Tan sheep skin products such as clothing, etc. not only have the characteristics of a high added value and good practicability, but also can more largely increase product benefits and lower the production cost.

BRIEF DESCRIPTION OF THE DRAWINGS

FIG. 1 is the process flow chart of the invention.

DETAILED DESCRIPTION OF THE PREFERRED EMBODIMENTS

The invention will be described below in the context of embodiments with references to figures, yet it should be understood that it is not to be intended to restrict the scope of the invention.

Embodiment 1

Material: Ningxia Tan sheep skin, a cutting and double-face leather integrated dyeing process for which comprises the following steps:

S1: Cutting: Selecting the third-grade Tan sheep skin to do the cutting treatment, the cutting length is about 2-3 cm;

S2: Washing with water: Washing the cut Tan sheep skin with water;

S3: Retanning: Retanning the Tan sheep skin washed with water;

S4: Primary dyeing: Putting the retanned Tan sheep skin into a paddle to do the primary dyeing treatment, and a temperature for the primary dyeing treatment being 60-70° C., lasting for 2-3 hours, a PH value of the primary dye liquor being 2.5-3.5, a liquid ratio being 1:20; said primary dye liquor including 0.5 ml/L of fur colour leveling agent FM, 5 g/L of anhydrous sodium sulfate, 0.5 ml/L of brightening agent HO and 1.5-5 g/L of acid dye;

S5: Primary colour fixing: After the primary dyeing treatment, the primary colour fixing treatment is done by putting 0.5-1.0 ml/L of formic acid into the paddle every 30 minutes for two to three times, and after the primary colour fixing, taking the skin out and changing the water;

S6: Secondary dyeing: After the primary colour fixing, putting the Tan sheep skin into the paddle to do the secondary dyeing treatment, and a temperature for the secondary dyeing treatment being 25-30° C., lasting for 60-70 minutes, a PH value of the secondary dye liquor being 2.0-3.0, a liquid ratio being 1:20; said secondary dye liquor including 0.5 g/L of leather board leveling agent, 0.5 ml/L of ammonia water and 2-4 g/L of leather board dye;

S7: Fatliquoring: After the secondary dyeing treatment, the fatliquoring treatment is done by putting a fatliquoring agent into the paddle and rotating it for 90-95 minutes, said fatliquoring agent including 3 ml/L of fatliquoring agent GH and 4 ml/L of fatliquoring agent FLP;

S8: Secondary colour fixing: After the fatliquoring, the secondary colour fixing treatment is done by putting 1.5-2.0 ml/L of formic acid into the paddle, and rotating it for 1 hour, then putting 1.5-2.0 ml/L of formic acid every 30 minutes for three to four times, and after the secondary colour fixing, taking the skin out;

S9: Bleaching: After the secondary colour fixing treatment, the bleaching treatment is done by putting 0.5-1.5 ml/L of fur degreasing agent FD-59 into the paddle and bleaching for 15-20 minutes;

S10: Drying: Shaking the bleached Tan sheep skin dry, nailing the skin on a plate, air drying naturally and getting a finished product.

The temperature for the retanning treatment in S3 is 35-40° C., lasting for 24 hours, and a retanning agent used in the retanning treatment includes 6-10 g/L of chromium powder, 20-30 g/L of salt and 0.5-1.5 ml/L of sulfuric acid.

The total quantity of formic acid added during the primary colour fixing in S5 is 2000-3000 ml.

The total quantity of formic acid added during the secondary colour fixing in S8 is 3000-4000 ml.

Test the exterior and interior quality of the finished Tan sheep skin leather acquired from Embodiment 1, such as odors, PH value, tuft length, fleece density of unit area, water and volatile matter, colour fastness, given load extensibility, tear load and so on, the main conditions are as follows:

TABLE 1

| Test Item | Unit | Technical Requirement | Measured Value | Individual Decision |
|---|---|---|---|---|
| Odors | — | none | none | qualified |
| PH value (leather board) | — | 3.8-6.5 | 6.4 | qualified |
| PH value (fleece) | — | 4.0-8.5 | 6.5 | qualified |
| Water and volatile matter | % | 10-18 | 11 | qualified |
| Tuft length | cm | ≥9 | 11 | qualified |
| Fleece density of unit area | Fleece number/cm$^2$ | ≥1500 | 2259 | qualified |
| Given load extensibility | % | ≥20 | 22 | qualified |
| Colour fastness | — | ≥3-4 | 5 | qualified |
| Tear load | N | ≥9 | 11 | qualified |

It can be learned from Table 1 that the measured values of the exterior and interior quality of the finished product of Tan sheep skin cut and double-face leather integrated dyed are all qualified, and meet the requirements of National and local related testing standards.

The invention claimed is:

1. A cutting and double-face leather integrated dyeing process for Tan sheep skin, wherein the process comprises the following steps:

S1: Cutting wherein the cutting is performed by selecting the third-grade Tan sheep skin to do the cutting treatment, the cutting length being about 2-3 cm;

S2: Washing with water wherein the washing with water is performed by washing the cut Tan sheep skin with water;

S3: Retanning wherein the retanning is performed by retanning the Tan sheep skin washed with water;

S4: Primary dyeing wherein the primary dyeing is performed by putting the retanned Tan sheep skin into a paddle to do the primary dyeing treatment, and a temperature for the primary dyeing treatment being 60-70° C., lasting for 2-3 hours, a pH value of the primary dye liquor being 2.5-3.5, a liquid ratio being 1:20; said primary dye liquor including 0.5 ml/L of fur colour leveling agent, 5 g/L of anhydrous sodium sulfate, 0.5 ml/L of brightening agent and 1.5-5 g/L of acid dye, the fur colour leveling agent being a composition of Propanetriol and fatty amine polyoxyethylene ether, the brightening agent being a composition of 25% Dimethylpolysiloxane, 5% Polyoxyethylene isodecyl ether and 70% water;

S5: Primary colour fixing wherein the primary colour fixing is performed by that after the primary dyeing treatment, the primary colour fixing treatment is done by putting 0.5-1.0 ml/L of formic acid into the paddle every 30 minutes for two to three times, and after the primary colour fixing, taking the skin out and changing the water;

S6: Secondary dyeing wherein the secondary dyeing is performed by that after the primary colour fixing, putting the Tan sheep skin into the paddle to do the secondary dyeing treatment, and a temperature for the secondary dyeing treatment being 25-30° C., lasting for 60-70 minutes, a pH value of the secondary dye liquor being 2.0-3.0, a liquid ratio being 1:20; said secondary dye liquor including 0.5 g/L of leather board leveling agent, 0.5 ml/L of ammonia water and 2-4 g/L of leather board dye;

S7: Fatliquoring wherein the fatliquoring is performed by that after the secondary dyeing treatment, the fatliquoring treatment is done by putting a fatliquoring agent into the paddle and rotating it for 90-95 minutes, said fatliquoring agent including 3 ml/L of a first fatliquoring agent and 4 ml/L of a second fatliquoring agent, the first fatliquoring agent being a composition of $C_{18}H_{38}$—O—$SO_3Na$ and Fatty Alcohol Polyoxyethylene Ether of the formula $C_{12}H_{25}O(CH_2CH_2O)_3H$ with 3 alcohol ethoxylates, the second fatliquoring agent being a composition of 49% water, 18% highly raffinated mineral oil, 8% Dodecyltrimethylammonium chloride, 5% Sodium bicarbonate, 10% Paraffin oil and 10% Vegetable oil;

S8: Secondary colour fixing wherein the secondary colour fixing is performed by that after the fatliquoring, the secondary colour fixing treatment is done by putting 1.5-2.0 ml/L of formic acid into the paddle, and rotating it for 1 hour, then putting 1.5-2.0 ml/L of formic acid every 30 minutes for three to four times, and after the secondary colour fixing, taking the skin out;

S9: Bleaching wherein the bleaching is performed by that after the secondary colour fixing treatment, the bleaching treatment is done by putting 0.5-1.5 ml/L of fur degreasing agent into the paddle and bleaching for 15-20 minutes, the Fur Degreasing Agent being a composition of Fatty Alcohol Polyoxyethylene Ether of the formula $RO(CH_2CH_2O)_nH$ with 9 alcohol ethoxylates wherein R=$C_{12-18}$ and n=15-16 and Sodium Alcohol Ether Sulphate;

S10: Drying wherein the drying is performed by shaking the bleached Tan sheep skin dry, nailing the skin on a plate, air drying naturally and getting a finished product.

2. The cutting and double-face leather integrated dyeing process for Tan sheep skin as claimed in claim 1, wherein, the temperature for the retanning treatment in S3 is 35-40° C., lasting for 24 hours, and a retanning agent used in the retanning treatment including 6-10 g/L of chromium powder, 20-30 g/L of salt and 0.5-1.5 ml/L of sulfuric acid.

3. The cutting and double-face leather integrated dyeing process for Tan sheep skin as claimed in claim 1, wherein, the total quantity of formic acid added during the primary colour fixing in S5 is 2000-3000 ml.

4. The cutting and double-face leather integrated dyeing process for Tan sheep skin as claimed in claim 1, wherein, the total quantity of formic acid added during the secondary colour fixing in S8 is 3000-4000 ml.

* * * * *